US011007522B2

(12) United States Patent
Brettschneider et al.

(10) Patent No.: US 11,007,522 B2
(45) Date of Patent: May 18, 2021

(54) DEVICE AND METHOD FOR STORING AND EMPTYING CONTAINERS FILLED WITH FLUID IN MICROFLUIDIC DEVICES

(71) Applicant: Robert Bosch GmbH, Stuttgart (DE)

(72) Inventors: Thomas Brettschneider, Leonberg (DE); Daniel Czurratis, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 376 days.

(21) Appl. No.: 15/764,027

(22) PCT Filed: Sep. 7, 2016

(86) PCT No.: PCT/EP2016/071049
§ 371 (c)(1),
(2) Date: Mar. 28, 2018

(87) PCT Pub. No.: WO2017/055039
PCT Pub. Date: Apr. 6, 2017

(65) Prior Publication Data

US 2018/0272344 A1 Sep. 27, 2018

(30) Foreign Application Priority Data

Sep. 29, 2015 (DE) ..... 10 2015 218 665.2

(51) Int. Cl.
*B01L 3/00* (2006.01)

(52) U.S. Cl.
CPC ..... *B01L 3/502715* (2013.01); *B01L 3/523* (2013.01); *B01L 2200/025* (2013.01);
(Continued)

(58) Field of Classification Search
CPC ..... B01L 3/502715; B01L 3/523; B01L 2200/025; B01L 2200/027; B01L 2200/16;
(Continued)

(56) References Cited

U.S. PATENT DOCUMENTS 5,525,298 A 6/1996 Anami
9,089,841 B2 7/2015 Shiraki et al.
(Continued)

FOREIGN PATENT DOCUMENTS

DE 39 38 559 A1 5/1991
DE 10 2012 222 719 A1 6/2014
(Continued)

OTHER PUBLICATIONS

International Search Report corresponding to PCT Application No. PCT/EP2016/071049, dated Nov. 18, 2016 (German and English language document) (7 pages).

*Primary Examiner* — Lore R Jarrett
(74) *Attorney, Agent, or Firm* — Maginot, Moore & Beck LLP

(57) ABSTRACT

A device for receiving and fluidically contacting a container for fluid, in particular a microfluidic device, includes a receiving unit configured to receive the container. The receiving unit includes at least one first hollow needle extending toward the received container, and at least one fixing element configured (i) to fix the received container at a predetermined distance from the needle, and (ii) such that the container is released in response to a force exceeding a predetermined threshold acting either (a) on the container in the direction of the needle, or (b) on the receiving unit in a direction toward the container. Release of the container enables the container and receiving unit to undergo a predetermined movement relative to each other such that the
(Continued)

needle penetrates a shell of the container to fluidically contact the container.

2 Claims, 7 Drawing Sheets

(52) U.S. Cl.
CPC ..... *B01L 2200/027* (2013.01); *B01L 2200/16* (2013.01); *B01L 2300/0672* (2013.01); *B01L 2300/123* (2013.01); *B01L 2400/0683* (2013.01)

(58) Field of Classification Search
CPC ..... B01L 2300/0672; B01L 2300/123; B01L 2400/0683
See application file for complete search history.

(56) References Cited

U.S. PATENT DOCUMENTS

| | | | | |
|---|---|---|---|---|
| 2003/0070498 | A1* | 4/2003 | Ohyama ..... | G01N 35/1079 73/863.01 |
| 2007/0048194 | A1 | 3/2007 | Schulein et al. | |
| 2007/0254372 | A1 | 11/2007 | Bickel et al. | |
| 2013/0071944 | A1* | 3/2013 | Ulrich ..... | B01L 3/502 436/174 |

FOREIGN PATENT DOCUMENTS

| | | | |
|---|---|---|---|
| DE | 10 2013 215 565 | A1 | 2/2015 |
| EP | 1 291 659 | A2 | 3/2003 |
| WO | 2015086741 | A1 | 6/2015 |

* cited by examiner

DEVICE AND METHOD FOR STORING AND EMPTYING CONTAINERS FILLED WITH FLUID IN MICROFLUIDIC DEVICES

This application is a 35 U.S.C. § 371 National Stage Application of PCT/EP2016/071049, filed on Sep. 7, 2016, which claims the benefit of priority to Serial No. DE 10 2015 218 665.2, filed on Sep. 29, 2015 in Germany, the disclosures of which are incorporated herein by reference in their entirety.

BACKGROUND

Lab-on-a-chip systems are microfluidic devices in which multiple functionalities of a macroscopic laboratory are accommodated on a plastic substrate which is for example the size of a credit card, and complex biological, diagnostic, chemical or physical processes can take place in a miniaturized form and in an at least partially automated manner. Here, the liquids and reagents required for this purpose may be introduced into a cartridge of the lab-on-a-chip system during operation or may already be pre-stored on the cartridge.

For example, DE 10 2012 222 719 A1 discloses a microfluidic cartridge in which a film bag, also referred to as a tubular bag, is pre-stored filled with fluid.

SUMMARY

The disclosure relates to a device, in particular a microfluidic device, for receiving and fluidically contacting a container for a fluid. The device comprises a receiving unit for receiving a container, wherein the receiving unit has at least one first hollow needle, and has at least one fixing element for fixing the received container at a predefined spacing from the first hollow needle. The first hollow needle extends in the direction of the received container. The fixing element is formed such that, when an exertion of force on the container in the direction of the first hollow needle, or on the receiving unit in the direction of the container, exceeds a predefined threshold value, the fixing of the container by way of the fixing element is released, and consequently a predefined movement of the receiving unit and the container relative to one another is made possible such that the first hollow needle penetrates a casing of the container for fluidic contacting of the container.

A "microfluidic device" may be understood in particular as meaning a microfluidic chip, a microfluidic cartridge or a lab-on-a-chip system. A "container for a fluid" may be understood in particular as meaning a blister or a tubular bag. The container may be at least partially filled with a fluid, for example with liquids or reagents, for processes to be carried out in the device. A "hollow needle" may be understood in particular as meaning a needle which at least partially has a duct, preferably along a section of the longitudinal axis of the needle, wherein the duct has, at least at one end, an opening to an outer region around the needle.

The device according to the disclosure has the advantage that liquids or reagents required for operation of the device, which are generally designed for storage in a long-term stable state, are able to be received in the device together with their respective container and stored in a long-term stable state until used. As a result of the receiving of the container, it is not necessary to provide the device itself with special materials which, for storage of the fluids or reagents in a long-term stable state, are characterized by sufficient barrier properties. Furthermore, as a result of the receiving of fluids and reagents together with their containers, it is also advantageous that a multiplicity of different fluids are able to be received in the same receiving unit since, as a result of the container being received along therewith, storage in a long-term stable state is ensured. In other words, the provision of specially configured storage chambers in the device, which chambers have to meet requirements for storage of different fluids or different reagents in a long-term stable state, is not necessary. It is also a particular advantage that emptying of the received container is able to be realized only directly before a processing procedure, by fluidic contacting by way of the first hollow needle. It is furthermore an advantage that the device according to the disclosure can, with or without a received container, be introduced into a microfluidic device also only shortly before a processing procedure.

Preferably, the device may also comprise multiple receiving units for receiving containers so that multiple containers can be received in the device with fluids or reagents necessary for operation of the device.

In an advantageous configuration of the disclosure, the at least one fixing element comprises a detent nose for the engagement with detent action of a part of the casing of the received container. This is particularly advantageous since, as a result of the configuration of a width and/or a depth of the detent nose, it is possible for the threshold value of the exertion of force for releasing the fixing of the container in the detent nose to be predefined. Here, the detent nose may, for example, be in the form of a depression or recess in the fixing element or in a surface of the receiving unit. Furthermore, the detent nose may for example be in the form of a depression or recess in a dome protruding from the fixing element or from a surface of the receiving unit, for example a bead-like elevation. This advantageously promotes clipping or wedging of the part of the casing into the detent noses.

A formation of at least one fixing element as a detent nose is advantageous in particular if a part of the casing of the container to be received projects from the container in relation to surroundings of the casing since engagement with detent action of the part into the detent nose is consequently facilitated. This is the case in particular with blister packs, which comprise a sealing or barrier film, wherein at least a part, in particular an end section, of the sealing or barrier film projects beyond the remaining casing of the blister and is thus particularly suitable for engagement with detent action into the detent nose.

In an advantageous refinement of the disclosure, the receiving unit comprises a second hollow needle which extends in the direction of the container and which is arranged such that, during the predefined movement of the receiving unit and the container relative to one another, the second hollow needle penetrates the casing of the container for introduction of a fluid into the container. As a result of fluidic contacting of the container via the second hollow needle, particularly effective emptying of the container is possible since a fluid introduced into the container via the second hollow needle is able to displace the fluid pre-stored in the container from the container into the device via the first hollow needle. For example, it is possible for the fluid introduced into the container via the second hollow needle to be a gas, for example nitrogen, a gas mixture, for example air, or a liquid. In the case of a liquid, it is preferably possible to use a liquid which does not mix with the fluid situated in the container. In particular, the introduction of a fluid via the second hollow needle allows the most complete possible emptying of the container.

According to an advantageous refinement of the disclosure, the receiving unit has a first surface, and has a second surface and a third surface which are in each case connected to the first surface. The second surface and the third surface are each connected to the first surface such that the surfaces delimit a receiving space for the container in a U-shaped manner, wherein the first and/or the second hollow needle extend from the first surface into the receiving space. This has the advantage that a container to be received is able to be fixed in a simple manner via one or more fixing elements arranged on the second surface and/or third surface.

Preferably, the second surface and the third surface are formed such that the receiving space tapers in the direction of the first surface. As a result of such tapering, it is advantageously achieved that a movement of the received container in the direction of the first and/or second hollow needle counteracts an increasing resistance as soon as the received container makes contact with the second and the third surface. In particular in the case of a blister as the container, the sealing or barrier film is thereby placed under stress, this facilitating penetration of the first or the second hollow needle into the container.

In an advantageous refinement of the disclosure, the second surface has a first fixing element, and the third surface has a second fixing element, for the fixing of the received container at the predefined spacing from the first hollow needle, wherein a length of the shortest spacing between the first fixing element and the second fixing element is between 0.3 centimeters and 5 centimeters, preferably between 0.5 centimeters and 1 centimeter. Since blisters are available in different standard sizes, in particular in a standard size where a width of the sealing or barrier film is 0.5-1.5 centimeters, this refinement has the advantage that a sealing or barrier film of a blister of the standard size experiences bending, and is placed under stress, when the blister is received and fixing is realized by way of the two fixing elements, as a result of which penetration of the first and/or second hollow needle into the blister is facilitated.

According to a further configuration of the disclosure, the first and/or the second hollow needle comprise a sealing ring arranged around the first and/or second hollow needle. This has the advantage that, after penetration of the first and/or second hollow needle, escape of fluid from the container around the piercing points on the outer sides of the needles is prevented, and thus controlled emptying of the fluid through the interior of the first hollow needle is ensured.

The disclosure also relates to an apparatus, in particular a microfluidic apparatus, having the device according to the disclosure and having an actuator, wherein at least a part of the actuator is designed so as to be movable in relation to the device. The actuator is arranged such that, when an exertion of force on the part of the actuator in the direction of the device, or on the device in the direction of the actuator, exceeds a predefined threshold value, a fixing of the container by way of the fixing element is released as a result of the exertion of force being passed on via the part of the actuator to a container received in the receiving unit of the device, and the predefined movement of the receiving unit and the container relative to one another is realized via a predefined movement of the part of the actuator and the device relative to one another. This has the advantage that, for releasing the fixing of the received container by way of the fixing elements, it is possible for a force to be applied not directly to the container but to an actuator which transmits the force to defined positions of the container according to a formation of the actuator. Since the contact positions of the actuator with respect to the received container can be defined via a formation of the actuator, it is possible via the formation, with consideration taken of the predefined threshold value of an exertion of force for releasing the container from the fixing of the fixing elements, for the predefined threshold value for the exertion of force on the part of the actuator in the direction of the device, or on the device in the direction of the actuator, to be fixed.

Preferably, the actuator comprises an elastic layer or a flexible diaphragm, which is able to be pressurized via a duct of the actuator or of the device. Such an elastic layer or flexible diaphragm has the advantage that, owing to the flexibility of the layer or diaphragm, a transmission of force to the received container via the elastic layer is able to be realized in a particularly uniform manner and over a large contact area between the layer or diaphragm and the container, with the result that the transmitted force or the transmitted pressure is distributed over a relatively large area of the container. This reduces the risk of unwanted destruction of the casing in the contact region between the actuator and the container.

According to a particularly advantageous refinement of the disclosure, the part of the actuator comprises at least one ram and/or a ram-like and/or stamp-like formation. Here, the actuator is arranged such that, during the exertion of force, at least part of the force acts on a predefined part of the casing of the container via contact of the ram and/or of the ram-like formation and/or of the stamp-like formation. In particular, the actuator may be arranged such that the part of the force acts on a projecting part of the casing of the container. Such a part of the actuator has the advantage that the transmission of force to the container is realized via a predefined position. In particular in the case of blisters being used as containers, in this refinement, it is possible for a transmission of force to be realized via an action of force of the ram on a projecting part of the casing of the blister, and another part of the casing, in particular that part of the casing which delimits the fluid, can be kept clear of an action of force by the actuator.

According to a preferred refinement of the disclosure, the apparatus comprises an insert element which, for transmitting force to the container, is arranged between the received container and the actuator. A corresponding formation of the insert element, wherein the insert element preferably comprises a ram- or stamp-like formation, allows an exertion of force transmitted to the insert element by the actuator to be transmitted in a targeted manner to defined positions of the received container.

In an advantageous refinement of the disclosure, the apparatus comprises a frame element, wherein the frame element frames at least a part of the receiving element, and wherein at least a part of the frame element is formed such that the part of the frame element prevents removal of a received container exceeding a predefined size. The formation of the part of the frame element determines in this case a minimum size for a container to be received in the receiving unit. In this embodiment, the elastic layer of the actuator is partially connected to the receiving element and is arranged between the receiving element and the frame element such that, during an expansion of the elastic layer in the direction of the frame element, which expansion goes beyond a predefined expansion, the receiving element is moved in the direction of the received container for fluidic contacting of the container. In this refinement, the frame element and the receiving element are thus movable in relation to one another. As a result of said formation of the part of the frame element, during a movement of the frame element and the receiving element in opposite directions away from one another, the received container is advantageously moved in the direction of the first and/or second hollow needle by the part of the frame element. It is thus possible by way of the moving apart of the frame element and the receiving element for the fluidic contacting of the container by the receiving element to be achieved.

The frame element may preferably have a U shape, wherein a space formed by way of the U shape is provided for receiving the receiving element.

Preferably, the formation of the part of the frame element is in the form of at least one hook, wherein the hook is preferably arranged in relation to a container exceeding the size such that, during the moving apart, the hook contacts a projecting part of the casing of the container, and when the moving apart is continued, the force underlying the moving apart is transmitted at least partially in the direction of the first and/or second hollow needle to the part of the casing.

Preferably arranged between the receiving element and the elastic layer is a duct for pressurizing the elastic layer, for example in the form of a recess in the receiving element. Said duct advantageously allows a positive pressure to be generated, for example by introduction of a fluid into the duct, in order to bring about expansion of the elastic layer in the direction of the frame element.

The disclosure also relates to a system comprising a device according to the disclosure and a container received in the receiving unit of the devices, wherein the container is at least partially filled with a fluid.

The disclosure furthermore relates to a method for receiving and emptying a container. In a first step, the container is received in a receiving unit having at least one first hollow needle, and is fixed at a predefined spacing from the first hollow needle by way of at least one fixing element of the receiving unit. In a second step, a force is exerted on the container in the direction of the first hollow needle, or on the receiving unit in the direction of the container, wherein the exerted force exceeds a predefined threshold value for releasing the fixing of the container. In a third step, the container and the receiving unit are moved toward one another such that the first hollow needle penetrates a casing of the container for fluidic contacting of the container.

BRIEF DESCRIPTION OF THE DRAWINGS

Exemplary embodiments of the disclosure are schematically illustrated in the drawings and are discussed in more detail in the description below. Elements of similar action illustrated in the various figures will be denoted by identical reference signs, wherein a repeated description of said elements will not be given.

In the figures.

DETAILED DESCRIPTION

Figure 1A:
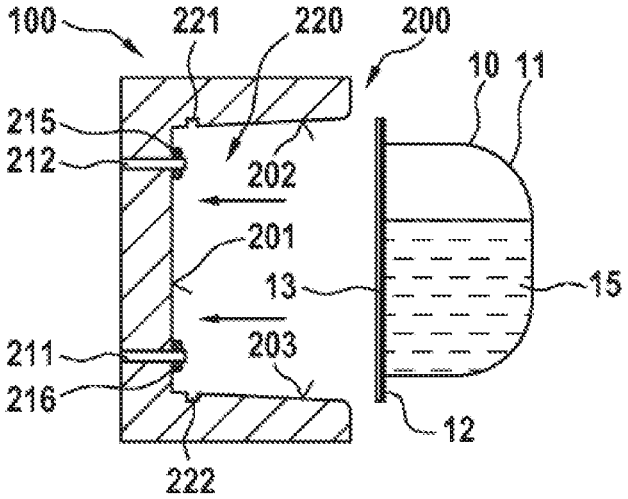
FIG. 1 shows a schematic illustration of an exemplary embodiment of the device according to the disclosure and of the system according to the disclosure.
Figure 1B:
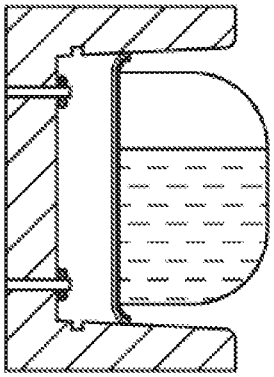
Figure 1C:
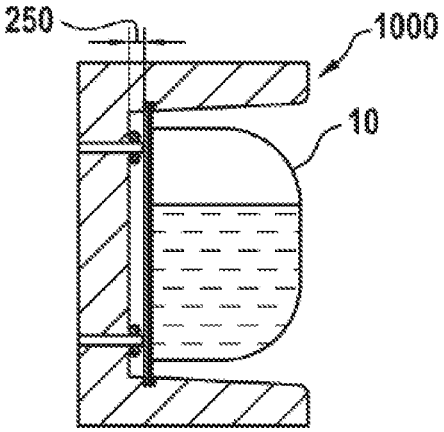

FIGS. 1*a* to 1*c* show an exemplary embodiment of the device 100 according to the disclosure for receiving and fluidically contacting a container 10 for a fluid. In this example, the container 10 is a blister with a casing 11, wherein the blister 10 is partially filled with a liquid 15, and wherein the casing 11 of the blister 10 comprises a barrier film 12. It is preferably possible to remove the liquid 15 via piercing or tearing-open of the barrier film 12.

The blister may in this case have for example a volume between 100 and 10 000 microliters. The casing 11 and in particular the barrier film 12 may comprise polymer composites with, for example, polypropelyne (PP), polyethylene (PE), cyclic olefin polymer (COP), cyclic olefin copolymer (COC), polymer-metal composites with, in particular, polyethylene terephthalate (PET)/aluminum (Al)/PE, PET/Al/PP, Al/PP, Al/PE, or other packaging materials which provide a diffusion barrier for the liquid 15 held in the container 10 and allow the liquid to be stored in a long-term stable state. For example, the barrier film 12 may have a thickness between 5 and 1000 micrometers. Preferably, the barrier film 12 also has a barrier layer 13 with an exemplary thickness of 5 to 500 micrometers, which comprises for example vapor-deposited aluminum, polychlorotrifluoroethylene, stretched and/or transversely drawn polypropylene film, or ethylene vinyl alcohol copolymer (EVOH).

The device 100 may be for example part of a lab-on-a-chip, microfluidic chip or microfluidic cartridge. The device 10 comprises a receiving unit 200 for receiving the container 10, wherein in this example, the receiving unit 200 comprises a first hollow needle 211 and a second hollow needle 212. The two hollow needles 211, 212 extend from a first surface 201 of the receiving unit 200. The receiving unit 200 also comprises a second surface 202 and a third surface 203 such that the surfaces 201, 202, 203 delimit a receiving space 220 for the received container 10 in a U-shaped manner, wherein the hollow needles 211, 212 extend partially into the receiving space 220. The receiving unit 200 may in particular comprise a polymer substrate, for example a thermoplastic such as PC, PP, PE, PMMA, COP, COC, and have a thickness of, for example, 0.5 to 5 mm. Here, the production of the receiving unit 200 may be realized by milling, injection molding, hot stamping, deep drawing or laser structuring.

The second side 202 and the third side 203 of the receiving unit 200 comprise a first fixing element 221 and a second fixing element 222, respectively, which elements are in the form of detent noses in this exemplary embodiment. In this example, a width of the first side 201 is formed so as to be smaller than a width of the barrier film 12 of the container 10 to be received, with the result that projecting ends of the barrier film 12 are able to engage with detent action into the two detent noses 221, 222, and the received container is thereby fixed at a predefined spacing 250 from the first side 201 and thus from the two hollow needles 211, 212. As illustrated in FIGS. 1*a* to 1*c*, the detent noses 221, 222 may be in the form of depressions or recesses in the second side 202 and the third side 203. Alternatively, it is also possible for the detent noses 221, 222 to be in the form of depressions or recesses in domes, for example bead-like elevations, protruding from the sides 202, 203. This makes it possible for the projecting ends of the barrier film 12 to be clipped or wedged into the detent noses 221, 222, as illustrated in the sequence of FIGS. 1*a*, 1*b*, 1*c*.

The predefined spacing 250 of the received and fixed container 10 in the receiving unit 200 is in this case selected such that damage of the barrier film 12 by the spaced-apart hollow needles 211, 212 in the case of normal vibrations during storage and transportation processes is prevented. For example, it is possible for a spacing 250 of 100 μm to 2 mm to be selected. In this example, the first hollow needle 211 and the second hollow needle 212 comprise a sealing ring 215, 216, arranged around the respective hollow needle, in order to prevent the fluid flowing outside the hollow needles when the barrier film 12 of the container 10 is pierced. Alternatively or additionally, the barrier film 12 may have an elastic layer 13 with an exemplary thickness of 5 to 500 micrometers, wherein the elasticity of the layer gives rise to additional sealing action around the hollow needles 211, 212. The elastic layer 13 may comprise a rubber, an elastomer, a thermoplastic elastomer and/or a silicone.

FIG. 1*c* shows, as a system 1000 of this exemplary embodiment, the device 100 with the received container 10.

In a refinement of the exemplary embodiment from FIG. 1, FIGS. 2*a* to 2*d* show an embodiment of the apparatus 500 according to the disclosure which comprises a device 100 according to the disclosure as per the exemplary embodiment from FIG. 1 and an actuator 300. As can be seen from FIG. 2*a*, the actuator 300 comprises in this exemplary embodiment two L-shaped parts 310 with in each case a ram-like formation 320 of the in each case longer section of the L shape, wherein the parts 310 are designed so as to be movable in relation to the device 100. The L shape of the parts 310 has the advantage that, via an action of force on the parts 310, the force can be transmitted to the projecting ends of the barrier film 12 of the container 10. If the force exceeds a predefined threshold, the fixing of the projecting ends of the film 12 of the container 10 in the detent noses 221, 222 is released, and the container 10 is moved in the direction of the hollow needles 211, 212 projecting from the first side 201 of the receiving unit 200. The magnitude of the predefined threshold is determined in this case by the specific formation of the detent noses 221, 222 and by the flexibility of the projecting ends of the barrier film 12 of the container 10. As an alternative to the two L-shaped parts 310, it would also be possible for the actuator to have for example a shape which partially surrounds the container 10, for example a U shape.

Figure 2A:
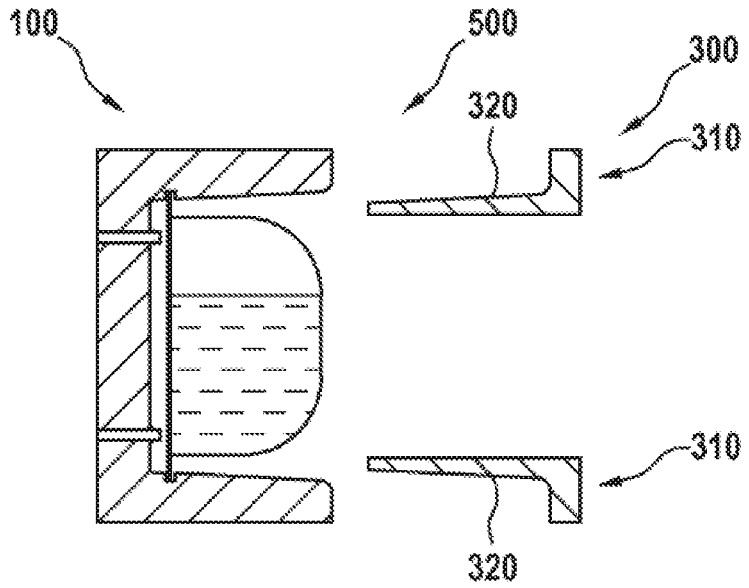
FIGS. 2 to 5 show a schematic illustration of exemplary embodiments of the apparatus according to the disclosure having a device according to the disclosure, and of the system according to the disclosure.
Figure 2B:
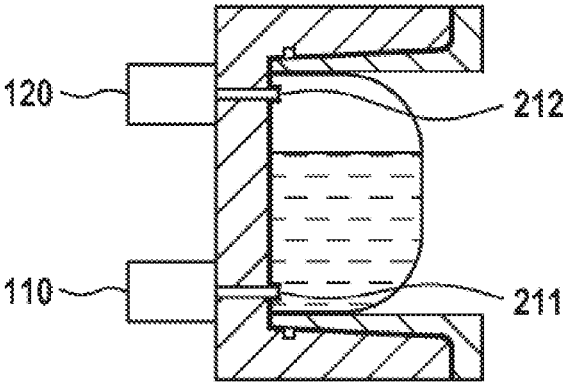

If the container 10 is moved via the movable parts of the actuator 310 further in the direction of the projecting hollow needles 211, 212, the latter pierce the barrier film 12 of the container 10, and a fluidic contact between the device 100 and the container 10 is established, as shown in FIG. 2*b*. Subsequently, it is possible via the first hollow needle 211 and/or via the second hollow needle 212 for a fluid 15 present in the container to be removed from the container 10. If during operation the device is arranged in a predefined orientation in the Earth's gravitational field, the liquid 15 can advantageously be removed from the container 10 via that one of the two hollow needles 211, 212 which is the bottom one in relation to the Earth's gravitational field. In this exemplary embodiment, the first hollow needle 211 is the bottom one of the two hollow needles 211 and 212, via which liquid 15 is removed. As is illustrated in FIG. 2*b*, in order to facilitate removal of the liquid 15, it is possible for the device to comprise a pump 110 which is connected to the first hollow needle 211. A particularly efficient emptying process 10 is achieved if, as indicated in the sequence of FIGS. 1*c* and 1*d*, a replacement fluid 16, for example a gas or gas mixture, is introduced into the container via the second hollow needle 212 in order to promote displacement of the liquid 15 from the container 10 through the first hollow needle 211. The introduction of the replacement fluid may in this case be realized via a second pump 120 of the device, wherein the second pump 120 is fluidically coupled to the second hollow needle 212 and may comprise a reservoir for the replacement fluid. Alternatively, it is possible for the second hollow needle 212 to be connected to the surroundings around the device 100 or around the apparatus 500 such that, when suctioning by the first pump 110 at the first hollow needle 211 occurs, air from the surroundings flows into the container 10 via the second hollow needle 212 as replacement fluid.

Figure 2C:
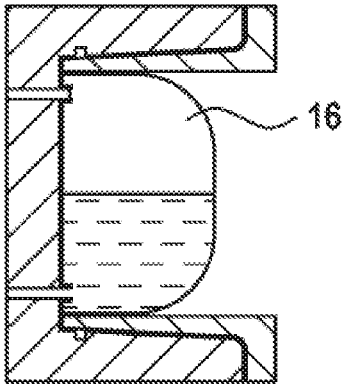
Figure 2D:
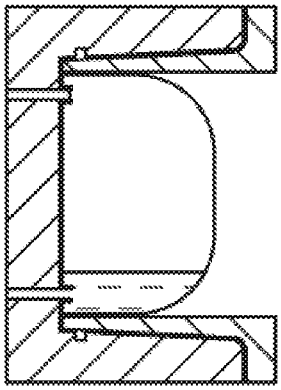

As emerges from FIGS. 2*b* to *d*, the movable parts 310 of the actuator 300 are preferably formed such that, during fluidic contacting of the container 10 with the device 100, the movable parts 310 contact the receiving unit 200 in a form-fitting manner, with the result that a further exertion of force on the actuator is passed on via the receiving unit 200, and the container 10 experiences no further force. Such form-fitting contacting may be realized for example by the L-shaped embodiment of the movable parts 310 of the actuator 300.

In order to facilitate penetration of the hollow needles 211, 212 into the container 10 through the barrier film 12, the hollow needles may comprise metal.

Figure 3A:
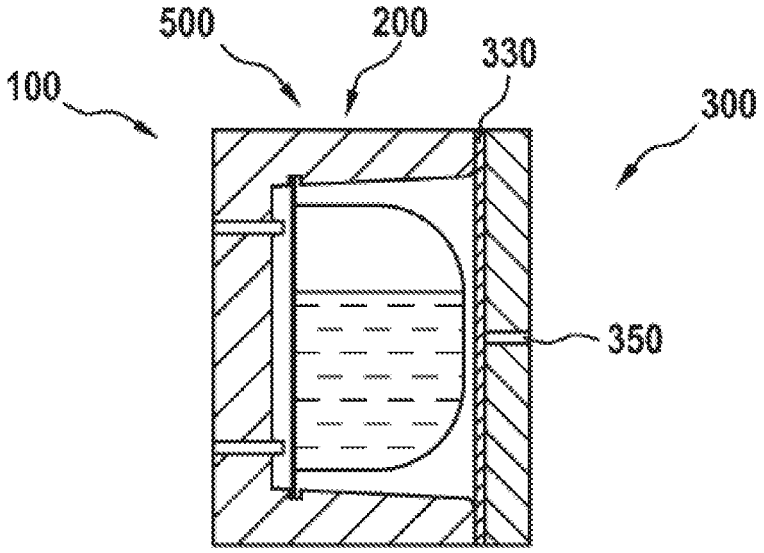
Figure 3B:
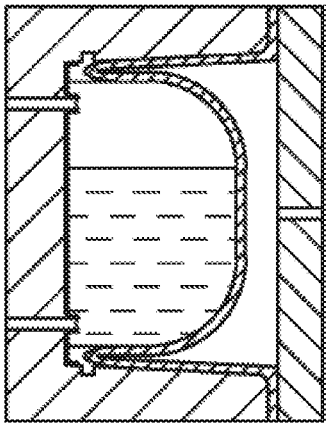
Figure 3C:
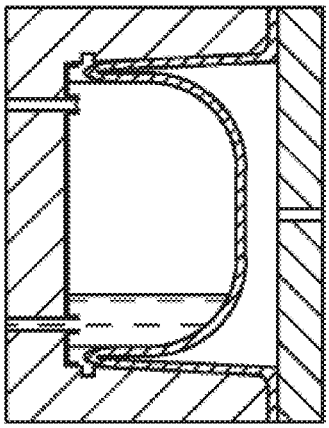

FIGS. 3*a* to 3*c* show an alternative refinement of the exemplary embodiment from FIG. 1, wherein in this exemplary embodiment, the apparatus 500 according to the disclosure comprises the device 100 according to the disclosure from FIG. 1 and an actuator 300 having a flexible diaphragm in the form of an elastic layer 330. It is possible for the diaphragm 330 to be pressurized via a duct 350 of the actuator 300, with the result that said diaphragm expands in the direction of the container 10, which has been received in the receiving unit 200 of the device 100, and transmits the pressure to the container 10 as a force. FIG. 3*b* shows that, as a result of an exertion of force, transmitted by the diaphragm 330, on the container 10, the container 10 was released from a fixing by way of the detent noses 221, 222 and was moved in the direction of the hollow needles 211, 212, with the result that the hollow needles 211, 212 pierce the barrier film 12 of the container 10. As illustrated in FIG. 3*c*, it is then possible for emptying of the container 10 to be realized for example via the first hollow needle 211.

Figure 4A:
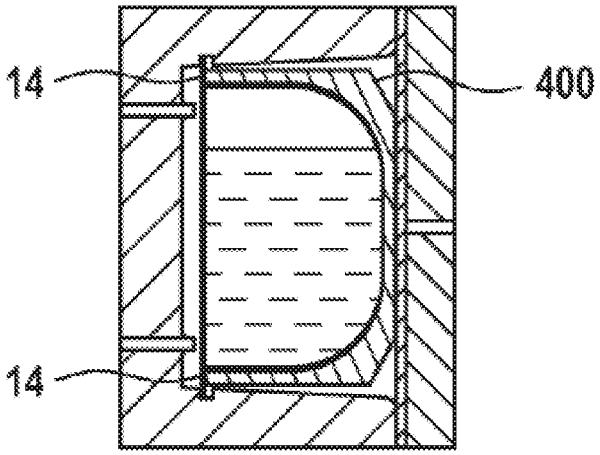
Figure 4B:
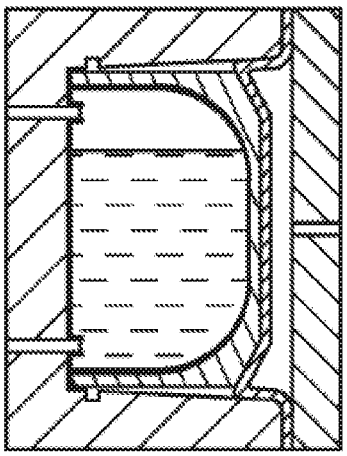

FIGS. 4*a* and 4*b* show a refinement of the exemplary embodiment from FIG. 3, wherein an insert part 400 is arranged between the film 330 of the actuator 300 and the container 10 received in the receiving unit 200. The insert part 400 may comprise the same materials as the receiving element 200. The insert part 400 has the advantage that a force transmitted by the diaphragm 330 is transmitted by the insert part 400 not to the entire casing 11 of the container 10 but only to projecting ends 14 of the barrier film 12. This reduces the risk of the container 10 being deformed and the casing 11 of the container 10 tearing as a result of positive pressure in the container 10.

Figure 5A:
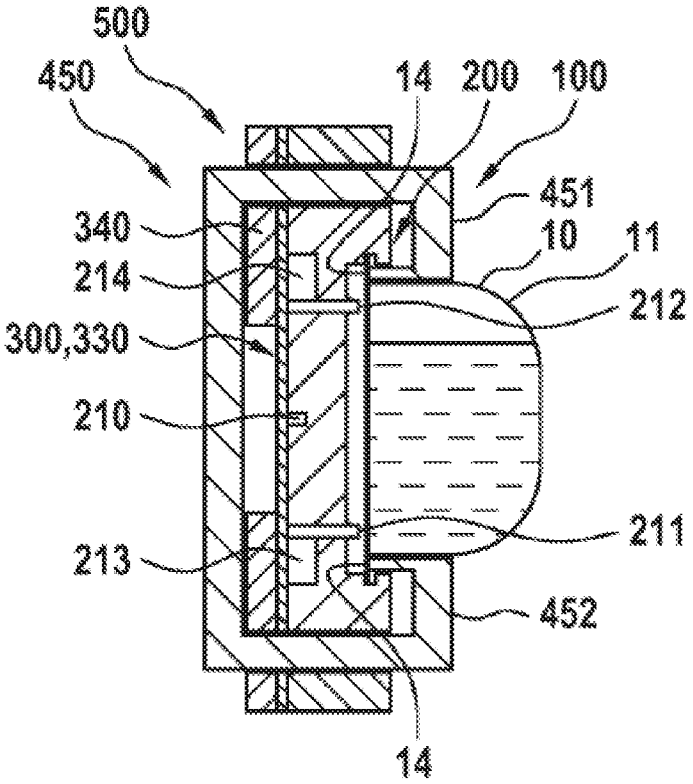
Figure 5B:
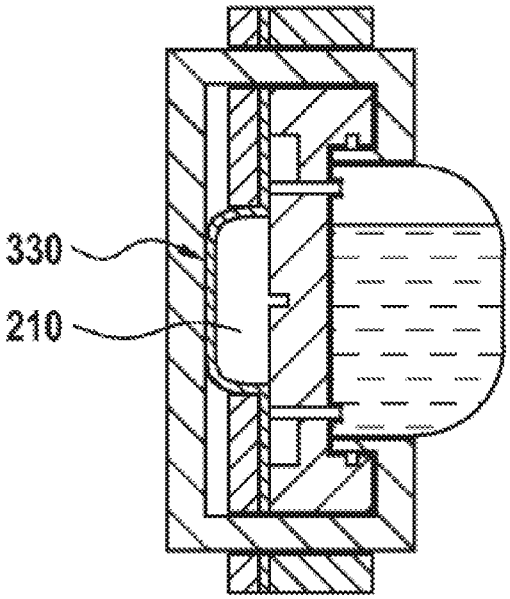

FIGS. 5*a* and 5*b* show an alternative refinement of the exemplary embodiment from FIG. 1, wherein in this exemplary embodiment, the apparatus 500 according to the disclosure comprises a device 100 according to the disclosure, an actuator 300 having an elastic layer 330, and a frame element 450. The frame element 450 frames at least a part of the receiving unit 200. A part 451, 452 of the frame element 450 is formed such that the part 451, 452 of the frame element 450 prevents removal of a received container 10, for example a blister, exceeding a predefined size. The frame element 450 may comprise the same materials as the receiving element 200. The elastic layer 330 of the actuator 300 is partially connected to the receiving element 200 and is arranged between the receiving element 200 and the frame element 450 such that, during an expansion of the elastic layer 330 in the direction of the frame element 450, which expansion goes beyond a predefined expansion, the receiving element 200 is moved in the direction of the received container 10 for fluidic contacting of the container 10, as indicated in the sequence of FIGS. 5*a* and 5*b*. In this embodiment, the frame element 450 and the receiving element 200 are thus movable relative to one another. As a result of said formation of the part 451, 452 of the frame element 450, when the frame element 450 and the receiving element 200 move away from one another, the received container 10 is advantageously moved in the direction of the first and second hollow needles 211, 212 by way of the part 451, 452 of the frame element 450. It is thus possible by way of the frame element 450 and the receiving element 200 moving apart for the fluidic contacting of the container 10 by the receiving element 200 to be achieved. In this example, the first and the second hollow needle 211, 212 are connected to a first duct 213 and to a second duct 214, respectively, wherein the ducts 213, 214 project out of the plane of the drawing in FIG. 5. In order to reinforce the bonding of the elastic diaphragm 330 to the receiving element 200, the diaphragm 330 may be arranged at least partially between the receiving element 200 and a substrate layer 340.

In this exemplary embodiment of the disclosure, the formation of the part 451, 452 of the frame element 450 is in the form of a first hook 451 and a second hook 452, wherein the hooks 451, 452 are preferably arranged in relation to a blister 10 exceeding the size such that, during the moving apart, the hook contacts a projecting part of the casing 11, that is to say in each case a projecting end 14 of the barrier film 12 of the blister 10, and when the moving apart is continued, the force underlying the moving apart is transmitted at least partially in the direction of the first and second hollow needles 211, 212 to the ends 14.

Preferably arranged between the receiving element 200 and the elastic layer 330 is a duct 210 for pressurizing the elastic, for example in the form of a recess 210 in the receiving element 200. Said duct 210 advantageously allows a positive pressure to be generated, for example by introduction of a fluid into the duct 210, in order to bring about expansion of the elastic layer 330 in the direction of the frame element 450 for fluidic contacting of the blister 10, as can be seen from FIG. 5*b*.

Figure 6:
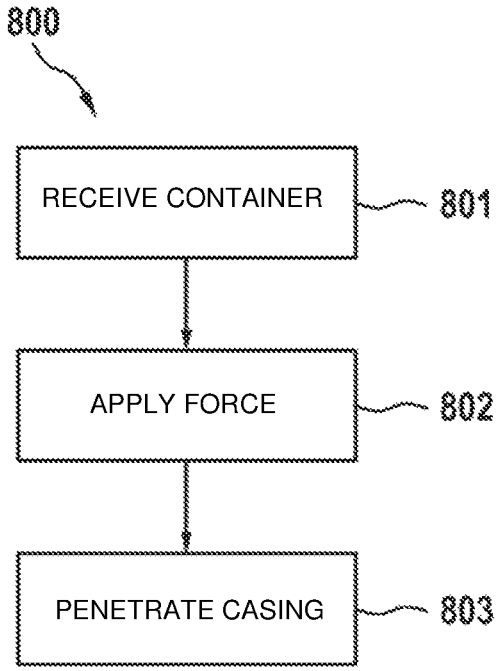
FIG. 6 shows a flow diagram of an exemplary embodiment of the method according to the disclosure.

FIG. 6 shows a flow diagram of an exemplary embodiment of the method 800 according to the disclosure. In a first step 801, a container is received in a receiving unit having at least one hollow needle, and is fixed at a predefined spacing from the first hollow needle by way of at least one fixing element of the receiving unit. In a second step 802, a force is exerted on the container in the direction of the first hollow needle, or on the receiving unit in the direction of the first container, wherein the force exerted exceeds a predefine threshold for releasing the fixing of the container. In a third step 803, the container and the receiving unit are moved toward one another such that the first hollow needle penetrates a casing of the container for fluidic contacting of the container.

The invention claimed is:

1. A microfluidic apparatus, comprising:

a container containing fluid;

a receiving unit including a receiving space configured to receive a portion of the container;

a first hollow needle extending into the receiving space, and at least one fixing element configured to releasably fix the container at a first location with respect to the receiving unit whereat the portion of the container is spaced apart from the first hollow needle, and an actuator configured to release the releasably fixed container upon actuation, wherein:

the actuator includes an elastic layer or a flexible diaphragm;

the actuator includes a duct configured to direct a pressurizing fluid against the elastic layer or flexible diaphragm; and the elastic layer or flexible diaphragm is configured to move the at least one of the container and the first needle such that the container is at a second location with respect to the receiving unit whereat the portion of the container is penetrated by the first hollow needle when the pressurized fluid is directed against the included elastic layer or flexible diaphragm.

2. The microfluidic apparatus as claimed in claim 1, wherein the apparatus further comprises:

a frame element configured to frame at least a part of the receiving unit to prevent removal of the removably fixed container;

wherein the included elastic layer or flexible diaphragm of the actuator is partially connected to the receiving unit and is positioned between the receiving unit and the frame element.

* * * * *